US010563393B2

(12) United States Patent
Michiels et al.

(10) Patent No.: US 10,563,393 B2
(45) Date of Patent: Feb. 18, 2020

(54) CONSTRUCTION ELEMENT FOR CONNECTING THERMALLY INSULATED PARTS OF A BUILDING

(71) Applicant: PLAKABETON S.A., Ternat (BE)

(72) Inventors: Pierre Michiels, Tervuren (BE); Olivier Remy, Brussels (BE)

(73) Assignee: PLAKABETON S.A., Ternat (BE)

( * ) Notice: Subject to any disclaimer, the term of this patent is extended or adjusted under 35 U.S.C. 154(b) by 0 days.

(21) Appl. No.: 16/069,466

(22) PCT Filed: Jan. 3, 2017

(86) PCT No.: PCT/EP2017/050076
§ 371 (c)(1),
(2) Date: Jul. 11, 2018

(87) PCT Pub. No.: WO2017/121658
PCT Pub. Date: Jul. 20, 2017

(65) Prior Publication Data

US 2019/0017256 A1 Jan. 17, 2019

(30) Foreign Application Priority Data

Jan. 12, 2016 (BE) ..... 2016/5019

(51) Int. Cl.
*E04B 1/00* (2006.01)
*E05B 63/08* (2006.01)
(Continued)

(52) U.S. Cl.
CPC ..... *E04B 1/0038* (2013.01); *E04B 1/78* (2013.01); *E04C 5/16* (2013.01); *E05B 63/08* (2013.01); *E05B 65/06* (2013.01); *E05C 9/041* (2013.01)

(58) Field of Classification Search
CPC . E04B 1/0038; E04B 1/78; E04C 5/16; E04C 5/07
See application file for complete search history.

(56) References Cited

U.S. PATENT DOCUMENTS

2008/0118304 A1* 5/2008 Carraher ..... B25H 3/04 403/396
2010/0031607 A1* 2/2010 Oliva ..... E04C 5/165 52/848

(Continued)

FOREIGN PATENT DOCUMENTS

DE 19543768 5/1997

OTHER PUBLICATIONS

International Search Report and Written Opinion for International Application No. PCT/EP2017/050076 dated Feb. 13, 2017 (10 pages).

*Primary Examiner* — Paola Agudelo
(74) *Attorney, Agent, or Firm* — Merchant & Gould P.C.

(57) ABSTRACT

A construction element is for forming a connection between two parts of a building that are thermally insulated from one another. The element includes an elongate portion having a thermally insulating material, and configured to be placed between the parts of the building. Bars run through the thermally insulating portion and are configured to be anchored in the building parts that are to be connected and thus to absorb the tensile forces between the building parts. The element includes an insulating portion for absorbing compression and shear forces between the building parts. The bars include metal bars, as well as non-metallic bars formed of a thermally insulating material. The metal bars are configured to maintain the connection when the tensile force absorbed by the non-metallic bars is lost.

7 Claims, 1 Drawing Sheet

(51) Int. Cl.

| | |
|---|---|
| ***E05B 65/06*** | (2006.01) |
| ***E05C 9/04*** | (2006.01) |
| ***E04B 1/78*** | (2006.01) |
| ***E04C 5/16*** | (2006.01) |

(56) References Cited

U.S. PATENT DOCUMENTS

| | | | | |
|---|---|---|---|---|
| 2011/0036049 | A1* | 2/2011 | Oliva | E04C 5/165<br>52/835 |
| 2012/0066994 | A1* | 3/2012 | Gibson | B29C 70/52<br>52/309.13 |
| 2012/0096804 | A1* | 4/2012 | Gutierrez Tenreiro | E01D 4/00<br>52/742.14 |
| 2012/0328896 | A1* | 12/2012 | Kar | E04C 5/03<br>428/544 |
| 2013/0276393 | A1* | 10/2013 | Froehlich | E04B 1/80<br>52/407.1 |

* cited by examiner

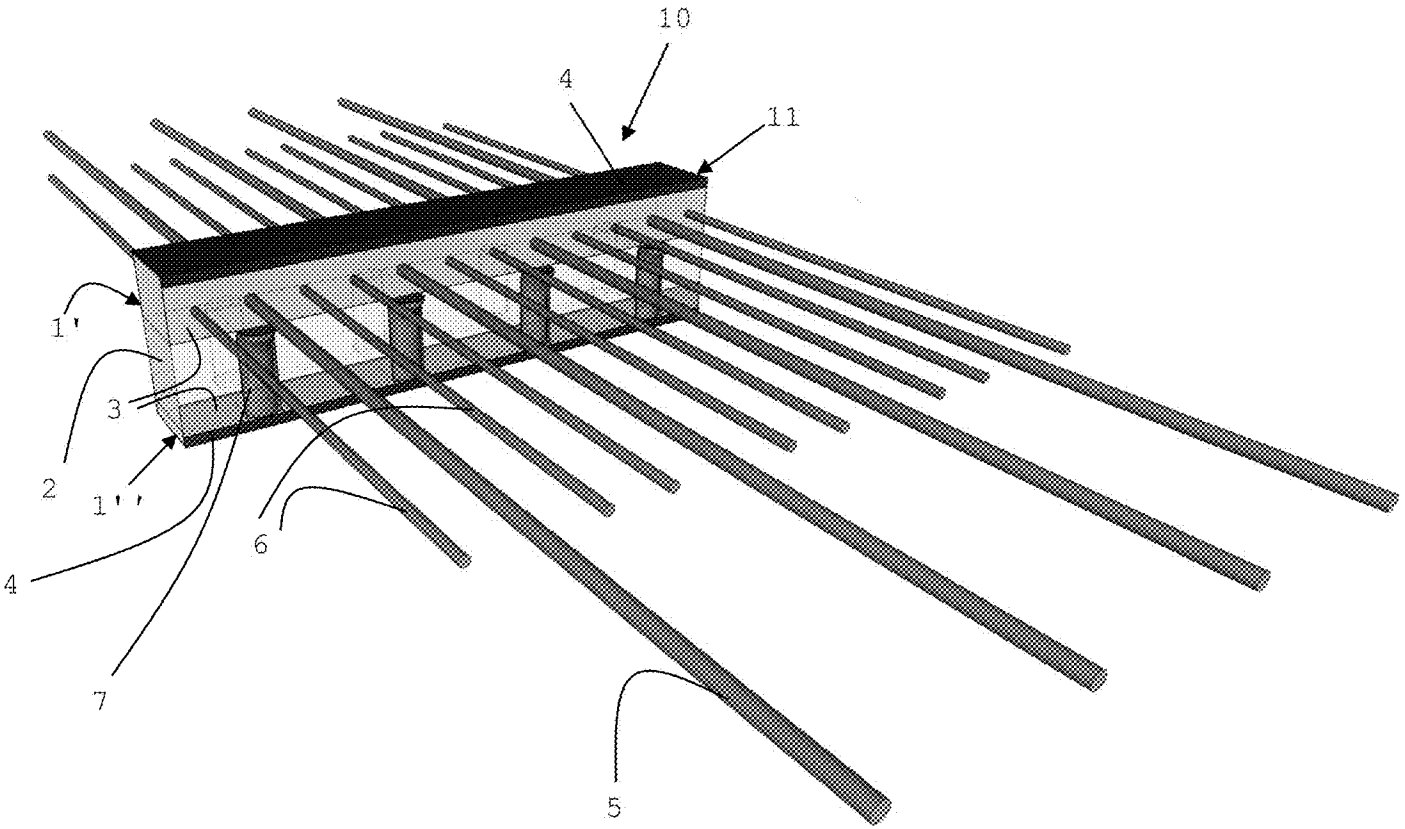
10
11
4
1'
2
3
1''
4
7
6
5

CONSTRUCTION ELEMENT FOR CONNECTING THERMALLY INSULATED PARTS OF A BUILDING

This application is a National Stage Application of PCT/EP2017/050076, filed 3 Jan. 2017, which claims benefit of Serial No. 2016/5019, filed 12 Jan. 2016 in Belgium and which applications are incorporated herein by reference. To the extent appropriate, a claim of priority is made to each of the above-disclosed applications.

FIELD OF THE INVENTION

The invention is related to a construction element applicable to the construction of buildings, in particular an element for connecting components of a building that are thermally insulated from one another, e.g. between a concrete floor and an overhanging floor of a balcony. These elements are also known as 'thermal breaks'.

PRIOR ART

Connections between internal parts of a building and overhanging external parts, e.g. a concrete balcony floor, need to be realized with a minimal impact on the insulation of the building. For creating this connection, elements are known that consist of an elongate insulating portion provided with reinforcement bars that run through the insulated portion and absorb the tensile forces between the parts of the building that are to be connected. Means are also provided to absorb compression and shear forces. The latter take the form, e.g. of pressure bars and bars running diagonally through the insulating portion, or of specially formed blocks that are incorporated into the insulating portion. The insulating portion is placed between the parts of the building which are to be connected, whilst the various force-absorbing elements are anchored in said building parts in order to form the connection.

Despite the presence of the insulating material, the force-absorbing elements are a major source of heat loss. The steel bars have high heat conductivity and thus form an important thermal bridge. The use of non-metallic tension bars has not yet been implemented. The strength of plastic tension bars or other alternatives may be high enough, but the heat resistance of these bars in the event of fire is inadequate. For thermal reasons, organic insulation materials such as PIR, PUR, EPS, XPS, etc. which are characterised by low fire resistance, are frequently used for the insulating portion. However, when these materials are used in combination with non-metallic tension members, the load-bearing capacity of the construction element is reduced or completely eliminated in the event of fire. Furthermore, the use of very thick layers of fire-resistant insulation material is impractical and expensive.

SUMMARY OF FEATURES OF THE INVENTION

The invention is related to a construction element as described in the appended claims. The construction element serves to form a connection between two parts of a building that are thermally insulated from one another, and comprises:

- an elongate portion comprising a thermally insulating material, and configured to be placed between the parts of the building,

- bars which run through the thermally insulating portion and which are configured to be anchored in the building parts that are to be connected, and thus to absorb the tensile forces between these building parts,
- means for absorbing compression and shear forces between the building parts, characterised in that the bars comprise metal bars, as well as non-metallic bars formed of a thermally insulating material, and wherein the metal bars are configured to maintain the connection when the tensile force absorbed by the non-metallic bars is lost, i.e. when the non-metallic bars are damaged or destroyed to the extent that they are no longer able to absorb any tensile force.

According to the preferred embodiment, 'maintain' refers to the preservation of the connection to a minimal extent in order to prevent collapse.

According to an embodiment, the metal bars are placed above the means for absorbing compression and shearing forces. A non-metallic bar may be placed on either side of each metal bar, at a short distance from the metal bar.

According to an embodiment, the construction element comprises groups of 3 bars, one central metal bar and two non-metallic bars, symmetrically placed with respect to the means for absorbing compression and shearing forces.

The means for absorbing compression and shearing forces may consist of support blocks that are arranged below in the elongate portion. The metal bars may be made of steel. The non-metallic bars may be basalt-based.

BRIEF DESCRIPTION OF THE FIGURES

FIG. 1 shows a three-dimensional image of a construction element according to one embodiment of the invention.

DETAILED DESCRIPTION OF PREFERRED EMBODIMENTS OF THE INVENTION

As shown in FIG. 1, the construction element according to the invention comprises the following elements: an elongate beam-shaped portion 11 comprising a shell that encloses a thermally insulating material 2, such as mineral wool or PIR (polyisocyanurate), PUR (polyurethane), EPS (expanded polystyrene), XPS (extruded polystyrene). In the embodiment shown, the shell comprises an upper part 1' and a lower part 1". Both parts are formed of metallic side walls 3 and a closing cap 4 made of plastic, e.g. PVC. The shell may also form a contiguous whole that completely surrounds the insulating material. In an upper portion of the shell, a number of bars 5/6 run through the beam-shamed portion 11 is. The bars 5/6 are configured to absorb the tensile force between the connected building parts. In a lower portion of the shell, support elements 7 are provided to absorb compression and shearing forces. These are support blocks made of a solid material, e.g. concrete, with the shape of the block and the composition of the material configured to absorb both compression and shearing forces. In and of itself, this type of block is known, and is described for example in document US 2013/0276393. Instead of these blocks, the more classic compression bars and bars running diagonally through the insulation may be provided. The construction element is placed in a building in the known manner by placing the insulating beam-shaped portion 11 between two parts of a building, e.g. between a first concrete floor inside the building and a second concrete floor that is connected to the building in an overhanging manner, with the bars and other force-absorbing elements anchored in the concrete floors.

It is characteristic of the invention that the construction element comprises both metal tension bars and non-metallic tension bars 6. The non-metallic tension bars 6 are thermally insulating. In other words, they are formed of a thermally insulating material, i.e. a material with negligible or very low heat conductivity. According to a preferred embodiment, these beams are basalt-based. For example, the beams may be made of a known material formed of a resin into which basalt fibres are incorporated. Other possible materials include materials based on glass fibres or Aramid polymers. The metal bars 5 are preferably made of stainless steel. In the embodiment shown, steal bars 5 are placed at regular intervals above the support elements 7 that absorb the compression and shearing forces. The metal bars 5 are preferably welded on the metal side walls 3 of the shell. On both sides of each metal bar 5, a non-metallic bar 6 is provided. In the embodiment shown, all bars are arranged at fixed distances from one another.

The number and placement of the metal and non-metallic bars is not limited however within the context of the invention. According to one preferred embodiment, 2 non-metallic bars 6 are placed at short distances on either side of one metal bar 5, so that the construction element comprises groups of three bars, with each group consisting of a metal bar 5 and two non-metallic bars 6. The central metal bars 5 are placed above the support blocks 7 or equivalent elements. The distances between the groups is determined by the distances between the supporting blocks 7. The 'short' distance between the metal bars 5 and the non-metallic bars 6 arranged on either side is short in relation to the fixed or average distance between the metal bars 5. The groups are preferably symmetric with regard to the support element 7, by the placement of the non-metallic bars 6 at an equal distance from the central metal bar 5.

The length and diameter of the metal bars (in other words the volume of metal used to produce these bars) is such that these metal bars by themselves are able to maintain the connection between the building parts to a minimal extent when the tensile force absorbed by the non-metal bars is eliminated, for example in the event of a fire.

The length and diameter of the non-metallic bars is such that the combined tensile force that can be absorbed by the metal and non-metallic bars is sufficient to meet the applicable strength standards under normal circumstances, i.e., when the metal and non-metallic bars are performing their normal function and neither of them is compromised or weakened (for example in the event of a fire).

Due to the contribution made by the non-metallic bars under normal circumstances, the amount of metal used for the metal bars may be less than in the case of a connection in which only metal bars are used. This means that the number of metal bars may be reduced. This reduces the heat loss caused by these bars, given that the non-metallic bars have little or no heat conductivity. An improvement in heat loss of 30% is possible. Additionally, the strength is guaranteed under normal circumstances by the presence of the non-metallic bars. In the event of fire, and in the worst-case scenario, the disappearance of the non-metallic bars, a minimum strength of the connection, sufficient to prevent collapse and allow for safe evacuation of the building, is guaranteed. The solution provided by the invention also makes it possible to produce the construction element without applying very thick layers of of fire-resistant material.

The invention claimed is:

1. Construction element for forming a connection between two parts of a building, the two parts of the building being thermally insulated from one another, comprising:

an elongate portion comprising a thermally insulating material, and configured to be placed between the parts of the building, bars extending through the elongate portion, the bars being configured to be anchored in the building parts that are to be connected, and to absorb tensile force between the parts of the building, means for absorbing compression and shearing forces between the parts of the building, wherein the bars comprise metal bars, and non-metallic bars formed of a thermally insulating material, and wherein the metal bars are configured to maintain a connection when the tensile force absorbed by the non-metallic bars is lost.

2. The construction element according to claim 1, wherein the metal bars are placed above the means for absorbing compression and shearing forces.

3. The construction element according to claim 1, wherein, on both sides of each metal bar, a non-metallic bar is placed spaced apart from the metal bar.

4. The construction element according to claim 1, comprising groups of 3 bars, each of the groups comprising one central metal bar and two non-metallic bars, symmetrically placed with respect to the means for absorbing compression and shearing forces.

5. The construction element according to claim 1, wherein the means for absorbing compression and shearing forces consist of support blocks arranged in a lower portion of the elongate portion.

6. The construction element according to claim 1, wherein the metal bars are made of steel.

7. The construction element according to claim 1, wherein the non-metallic bars are basalt-based.

* * * * *